US010619386B2

(12) United States Patent
Chen et al.

(10) Patent No.: US 10,619,386 B2
(45) Date of Patent: Apr. 14, 2020

(54) QUICK RELEASE LATCH

(71) Applicant: Quanta Computer Inc., Taoyuan (TW)

(72) Inventors: Chao-Jung Chen, Taoyuan (TW); Yaw-Tzorng Tsorng, Taoyuan (TW); Chun Chang, Taoyuan (TW); Cheng-Chieh Weng, Taoyuan (TW)

(73) Assignee: QUANTA COMPUTER INC., Taoyuan (TW)

( * ) Notice: Subject to any disclaimer, the term of this patent is extended or adjusted under 35 U.S.C. 154(b) by 969 days.

(21) Appl. No.: 14/989,128

(22) Filed: Jan. 6, 2016

(65) Prior Publication Data

US 2017/0191292 A1 Jul. 6, 2017

(51) Int. Cl.
*E05C 1/06* (2006.01)
*E05B 65/00* (2006.01)

(52) U.S. Cl.
CPC ..... *E05C 1/065* (2013.01); *E05B 65/006* (2013.01); *Y10T 292/0826* (2015.04); *Y10T 292/0828* (2015.04); *Y10T 292/0831* (2015.04); *Y10T 292/0839* (2015.04); *Y10T 292/0871* (2015.04); *Y10T 292/096* (2015.04);
(Continued)

(58) Field of Classification Search
CPC ..... E05C 1/065; E05B 65/006; Y10T 292/57; Y10T 292/0826; Y10T 292/0828; Y10T 292/0831; Y10T 292/0839; Y10T 292/0921; Y10T 292/0922; Y10T 292/0923; Y10T 292/0967; Y10T 292/0994; Y10T 292/0871; Y10T 292/1015; Y10T 292/0972; Y10T 292/0974; Y10T 292/1009; Y10T 292/096; Y10T 292/102
USPC ..... 220/262, 324, 345.1, 345.2, 345.3; 361/683, 724–727; 312/222, 223.3; 292/DIG. 63, DIG. 11, DIG. 31
See application file for complete search history.

(56) References Cited

U.S. PATENT DOCUMENTS 2,703,431 A * 3/1955 Tatom ..... E05C 19/145 16/258
3,057,053 A * 10/1962 Schlage ..... E04F 21/003 29/407.1

(Continued)

FOREIGN PATENT DOCUMENTS

CN 202995593 U 6/2013
CN 104460881 A 3/2015

OTHER PUBLICATIONS

CN Office Action for Application No. 201610230056.5 dated Mar. 11, 2019, w/ First Office Action Summary.

(Continued)

*Primary Examiner* — Kristina R Fulton
*Assistant Examiner* — Faria F Ahmad
(74) *Attorney, Agent, or Firm* — Nixon Peabody LLP; Zhou Lu

(57) ABSTRACT

A latch having a support bracket having a guide slot formed in a bottom surface. A linkage at least partially received within the guide slot and a handle coupled to the linkage transitionable between an open position and a closed position. A pin releasably coupled to the linkage such that when the handle is in the closed position the pin is coupled to the linkage and in the open position the pin is removable from the linkage. As the handle transitions from the open position to the closed position, the linkage moves within the guide slot.

6 Claims, 12 Drawing Sheets

(52) U.S. Cl.
CPC .... *Y10T 292/0921* (2015.04); *Y10T 292/0922* (2015.04); *Y10T 292/0923* (2015.04); *Y10T 292/0967* (2015.04); *Y10T 292/0972* (2015.04); *Y10T 292/0974* (2015.04); *Y10T 292/0994* (2015.04); *Y10T 292/102* (2015.04); *Y10T 292/1009* (2015.04); *Y10T 292/1015* (2015.04); *Y10T 292/57* (2015.04)

(56) References Cited

U.S. PATENT DOCUMENTS 3,130,996 A * 4/1964 Moxness ..... E05C 1/16 292/173
4,370,874 A * 2/1983 Munn ..... E05B 5/00 292/204
4,704,882 A * 11/1987 Takasaki ..... E05B 65/0053 292/173
4,828,299 A * 5/1989 Poe ..... E05B 63/128 292/139
5,740,012 A * 4/1998 Choi ..... G06F 1/1616 361/679.39
6,108,196 A * 8/2000 Jung ..... E05B 17/0037 361/679.55
6,125,040 A * 9/2000 Nobuchi ..... E05B 63/14 312/223.1
6,174,007 B1 * 1/2001 Schlack ..... E05B 5/00 292/336.3
6,178,343 B1 1/2001 Bindszus et al.
6,460,902 B1 * 10/2002 Kyle ..... E05C 1/145 114/203
6,517,129 B1 * 2/2003 Chien ..... E05B 63/248 292/121
6,917,518 B2 * 7/2005 Chen ..... G06F 1/181 361/724
6,927,972 B1 * 8/2005 Wang ..... G06F 1/1616 361/679.55
7,325,846 B2 * 2/2008 Smith ..... E05C 19/006 292/137
7,843,698 B2 * 11/2010 Takizawa ..... G06F 1/181 361/732
8,245,548 B2 * 8/2012 Sibley ..... E05B 81/76 292/336.3
8,270,173 B2 * 9/2012 Chang ..... H05K 5/0221 361/679.01
8,590,108 B2 * 11/2013 Baik ..... G06F 1/181 16/419
8,837,129 B2 * 9/2014 Fu ..... H05K 7/1487 361/679.02
8,899,702 B2 * 12/2014 Mao ..... H05K 7/1487 312/222
9,207,721 B2 * 12/2015 Conn ..... G06F 1/181
9,243,427 B2 * 1/2016 Weber ..... E05B 47/0009
9,380,718 B2 * 6/2016 Wang ..... H05K 5/0221
D777,558 S * 1/2017 Magee ..... E05B 15/025 D8/343
2002/0182896 A1 * 12/2002 Welsh ..... H05K 7/1409 439/1
2004/0021325 A1 * 2/2004 Schlack ..... E05C 1/065 292/110
2004/0222647 A1 * 11/2004 Smith ..... E05C 19/006 292/336.3
2005/0023838 A1 * 2/2005 Schlack ..... E05B 9/08 292/66
2007/0080542 A1 * 4/2007 Ookawara ..... E05B 83/30 292/36
2011/0127895 A1 * 6/2011 Conn ..... G06F 1/181 312/294
2011/0157779 A1 * 6/2011 Chang ..... H05K 5/0221 361/679.01
2013/0146596 A1 * 6/2013 Chen ..... G06F 1/181 220/262

OTHER PUBLICATIONS

CN Search Report for Application No. 201610230056.5 dated Mar. 11, 2019, w/ First Office Action.

* cited by examiner

QUICK RELEASE LATCH

FIELD

The subject matter herein generally relates to a quick release latches. More specifically, the subject matter herein relates to a quick release for accessing a receiving space of a housing.

BACKGROUND

Electronic devices have housings with removable lids to provide access to a receiving space containing various components of the electronic device. The removable lid provides access to the receiving space for maintenance, replacement, and upgrade of components throughout the life of the electronic device. The lid secured to the housing often has a releasable latch that requires actuation and then separate actuation to slide the lid removal direction. This two-step process requires a user to actuate the latch and slide the lid independently to access the receiving space.

BRIEF DESCRIPTION OF THE DRAWINGS

Implementations of the present technology will now be described, by way of example only, with reference to the attached figures, wherein.

DETAILED DESCRIPTION

Figure 1:
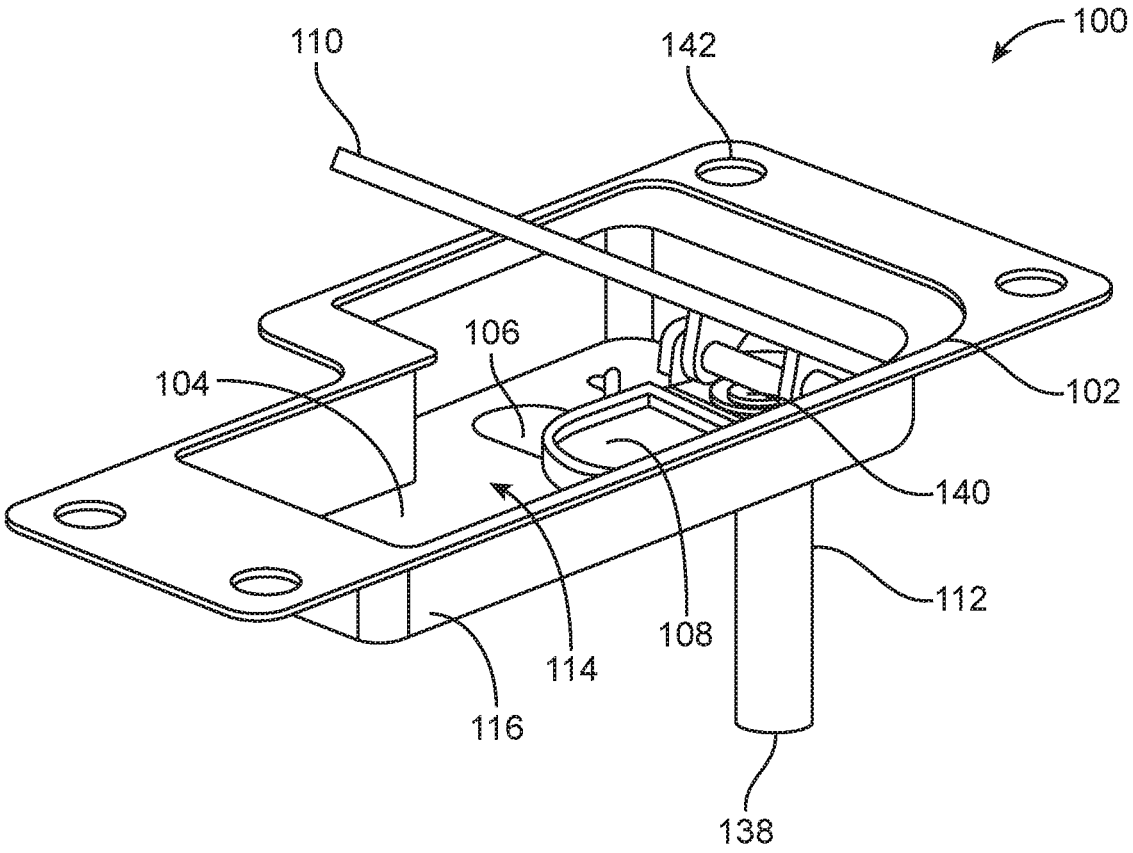
FIG. 1 is an elevational view of a releasable latch in a closed position in accordance with an example embodiment of the present technology.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" means "including, but not necessarily limited to"; it specifically indicates open-ended inclusion or membership in a so-described combination, group, series and the like.

The present disclosure is focused on increasing the ease of removing and installing a cover for a housing. The cover can be removable from the housing by operation of a latch. In at least one embodiment, the cover can be a lid to a sever assembly. The latch can have a support bracket with a guide slot formed in a bottom surface. A rotary linkage can be at least partially received within the guide slot and a handle coupled to the rotary linkage. The handle can actuate the rotary linkage within the guide slot. The handle and rotary linkage transitionable between an open position and a closed position. A pin releasably coupled to the rotary linkage such that when the handle is in the closed position the pin is coupled to the rotary linkage and when the handle is in the open position the pin is removable from the rotary linkage. Further, as the handle transitions from the open position to the closed position, the rotary linkage moves within the guide slot thereby causing the support bracket to translate relative to the pin.

The present disclosure illustrates a server assembly having a releasable latch. The server assembly can have a housing forming a receiving space. A pin can be coupled to the housing within the receiving space. A lid can be slidably coupled to the housing and a latch coupled to the lid. The latch can include a support bracket having a guide slot formed in a bottom surface, a rotary linkage at least partially received within the guide slot and configured to receive the pin, and a handle coupled to the rotary linkage and transitionable between an open position and a closed position. When the handle is in the closed position, the pin is coupled to the rotary linkage and when the handle is in the open position the pin is removable from the rotary linkage. As the handle transitions from the closed position to the open position the rotary linkage moves within the guide slot and as the handle transitions from the closed position to the open position, the lid slides relative to the housing, thereby decoupling from the housing and providing access to the receiving space.

While the present disclosure is discussed in reference to orientation server rack assembly of the illustrated embodiments, it is within this disclosure to vary the implementation of the releasable latch to any device requiring releasable coupling.

Figure 2:
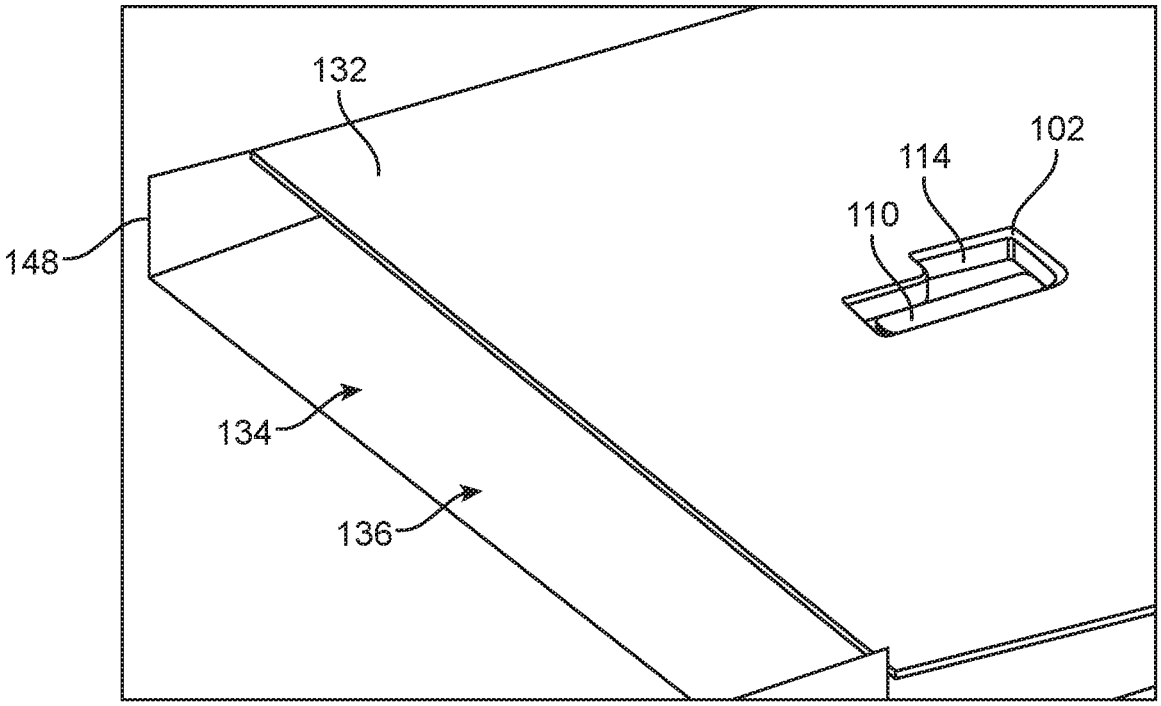
FIG. 2 is an isometric view of a releasable latch in a closed position in accordance with an example embodiment of the present technology.

FIGS. 1 and 2 illustrate an example embodiment of a releasable latch in a closed configuration. The latch 100 has a support bracket 102 with a bottom surface 104 having a guide slot 106 formed therein. A rotary linkage 108 is at least partially received within the guide slot 106 and a handle 110 is coupled to the rotary linkage 108. The handle 110 can be pivotably coupled to the rotary linkage 108, allowing the handle 110 to be lifted and lowered relative to the rotary linkage 108. In at least one embodiment, the handle 110 and rotary linkage 108 are substantially parallel in an un-lifted position and not parallel when the handle 110 is lifted relative to the rotary linkage 108. A pin 112 is releasably coupled to the rotary linkage 108. In at least one embodiment, the pin 112 is at least partially receivable within the rotary linkage. In other embodiments, the pin is coupled to the rotary linkage using a tongue and groove arrangement.

The handle 110 is transitionable between an open position and a closed position. In the open position, the pin 112 is removable from the rotary linkage 108. In the closed position, the pin 112 is coupled to the rotary linkage 108. When the handle 110 transitions between the open position and the closed position, the rotary linkage 108 moves within the guide slot 106.

As can be appreciated in FIGS. 1 and 2, the support bracket 102 has a receiving space 114 formed by a plurality of sidewalls 116. The handle 110 and the rotary linkage 108 are oblong in shape and received in the receiving space 114. As can be appreciated in FIG. 2, the handle 110 is received within the receiving space 114 forming a substantially flush top surface with the support bracket 102. As can be appreciated in FIG. 1, the handle 110 is lifted out of the receiving space 114 to allow a user to transition the handle between the open and closed position. In the closed position, the handle 110 can be completely received within the receiving space 114 of the support bracket 102. In the open position, the handle 110 can be at least partially removed from the receiving space 114 of the support bracket 102. In other embodiments, the receiving space 114 can be configured to accommodate the handle 110 in both the open position and the closed position.

As can further be appreciated in FIGS. 1 and 2, the support bracket 102 can have a plurality of securing apertures 142 formed along the perimeter. The plurality of securing apertures 142 couple the support bracket 102 and latch 100 to a cover 132 of a housing 134. The housing 134 can have at least one sidewall 148 forming a receiving space 136. In at least one embodiment, when in the closed position the cover 132 engages at least one sidewall 148 of the housing 134 to secure the cover 132 to the housing. In the open position, the cover 132 is disengaged from the at least one sidewall 148 of the housing allowing the cover 132 to be removed from the housing 134.

In other embodiments, the latch 100 and support bracket 102 can be coupled to any other surface including, but not limited to, doors, windows, drawers, electronic devices, or any other closable surface operated by a latch 100 known in the art.

The pin 112 is stationary and longitudinally extending having two ends, a first end 138 and a second end 140. The first end 138 coupled to a bottom surface 144 of the receiving space 136, thereby fixing the pin 112 relative to the support bracket, and the second end 140 receivable in the rotary linkage 108.

Figure 3:
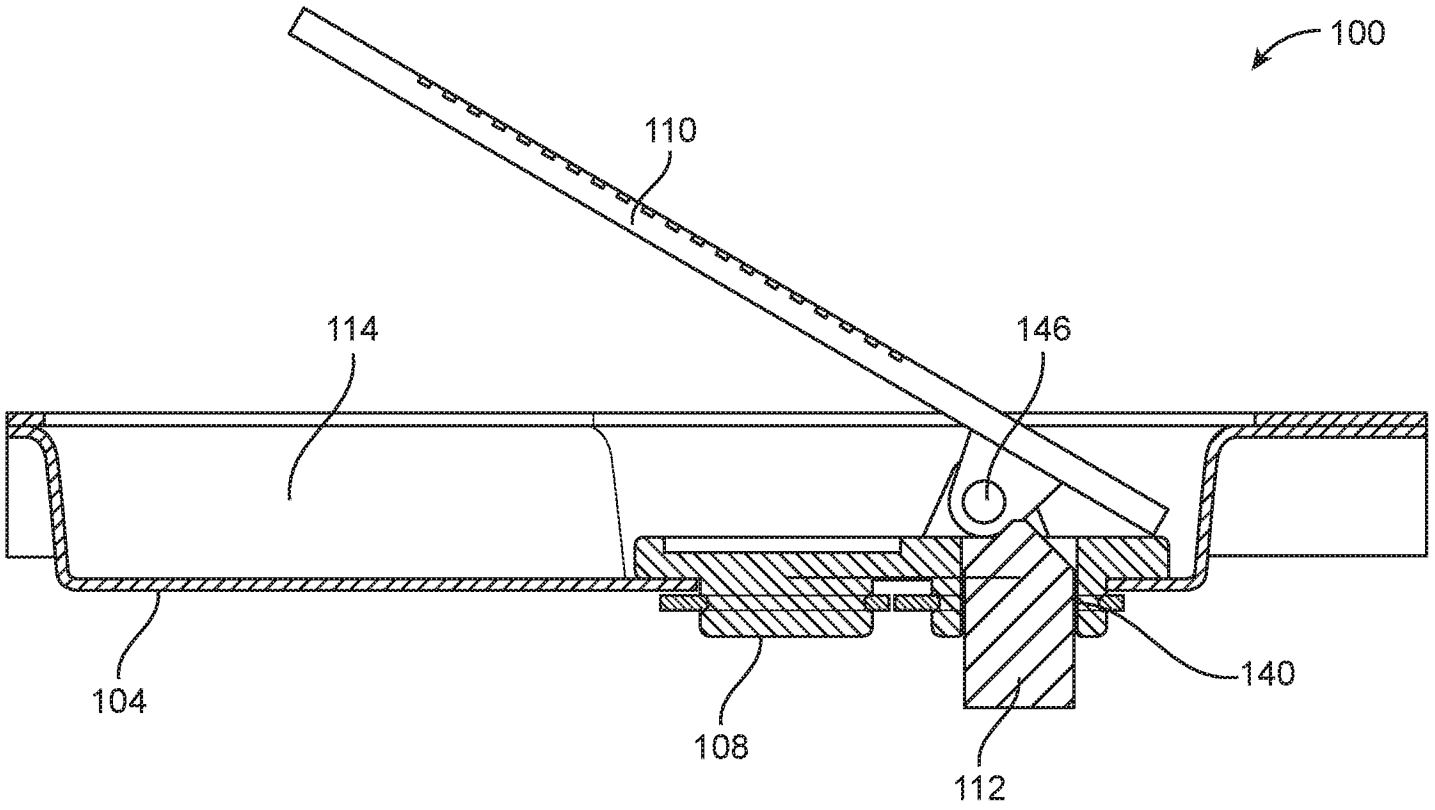
FIG. 3 is a cross-sectional view of a releasable latch in accordance with an example embodiment of the present technology.

FIG. 3 illustrates a cross section view of an example embodiment of a releasable latch in a closed position. In the closed position, the pin 112 is coupled to the rotary linkage 108. The rotary linkage 108 has a fixed hinge 124 at a first end 126 of the oblong shape and a rotary hinge 128 at the second end 130. The pin 112 is coupled to the rotary linkage 108 at the fixed hinge 124. As can be appreciated in FIG. 3, the second end 140 of the pin 112 is at least partially received within the rotary linkage 108 at the fixed hinge 124. The handle 110 is pivotably coupled to the rotary linkage 108 by a pivot pin 146 at one end of the oblong handle 110 maximizing the surface area of the handle available to a user for transitioning the handle 110 between the open position and closed position. In other embodiments, the handle 110 can be coupled to the rotary linkage 108 by a hinge, a spring biased hinge, or other pivotable couplings known in the art. In yet other embodiments, the handle 110 and the rotary linkage 108 can be integrally formed together from a material having sufficient flexibility to allow the handle 110 deflect away from the rotary linkage 108.

Figure 4:
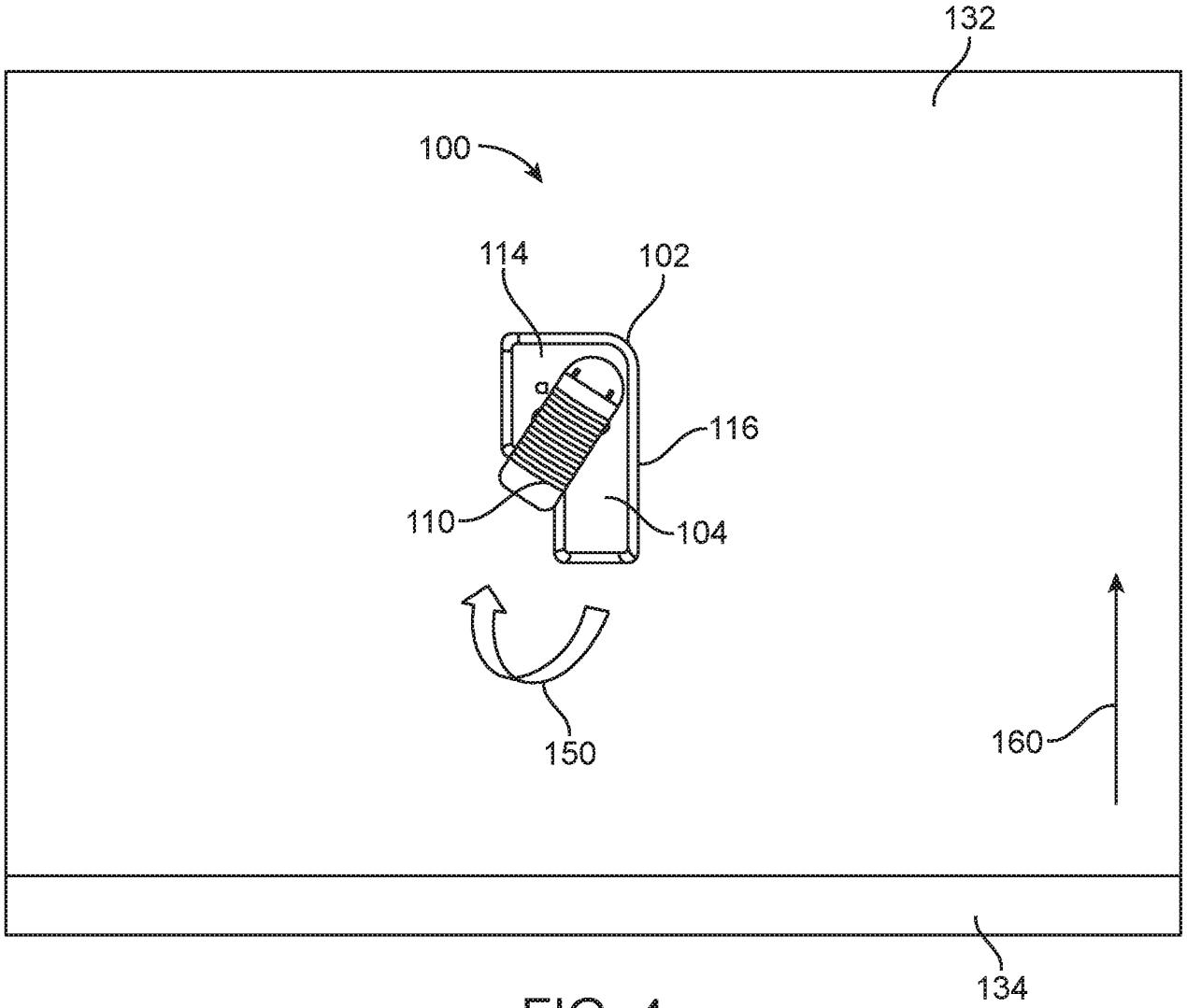
FIG. 4 is a top plan view of a releasable latch in accordance with an example embodiment of the present technology.
Figure 5:
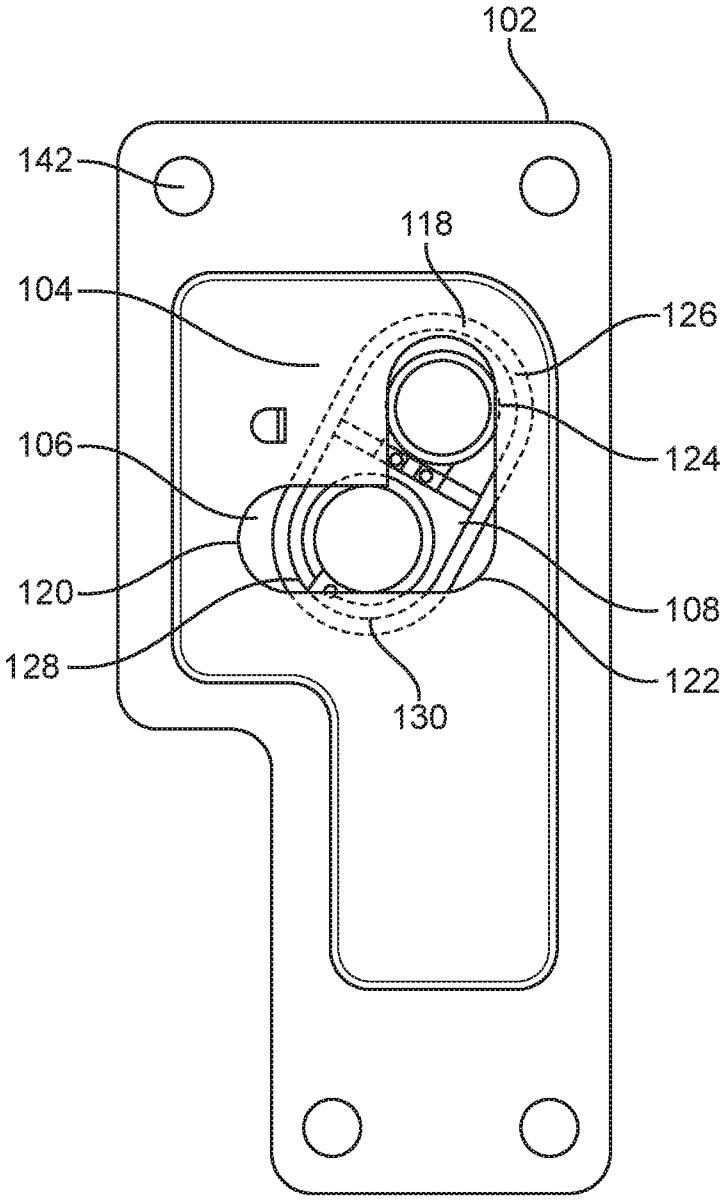
FIG. 5 is a top plan view of a releasable latch in accordance with an example embodiment of the present technology.

FIGS. 4 and 5 illustrate an example embodiment of a releasable latch transitioning from a closed position to an open position. The latch 100 transitions from the closed position to the open position by actuating the handle in rotational direction 150, thereby releasing pin 112. The rotary linkage 108 is coupled to the handle 110 and travels within guide slot 106 as the latch transitions from the closed position to the open position.

As can be appreciated in FIG. 4, the latch 100 is coupled to a cover 132 of a housing 134. Transitioning the latch 100 from a closed position to an open position requires rotating the handle 110 in rotational direction 150. In at least one embodiment, the rotational direction 150 is clockwise. In other embodiments, the rotational direction 150 is counter-clockwise.

As the handle 110 rotates, the rotary linkage 108 moves within the guide slot 106. The pin 112 is secured to the receiving space 136 of the housing 134 causing the cover 132 to be displaced in sliding direction 160 as the handle 110 rotates and the rotary linkage 108 moves within the guide slot 106. (Shown in FIG. 1).

As can be appreciated in FIG. 5, the guide slot 106 is substantially L-shaped having two end portions 118, 120 and a middle portion 122. In the closed position, the fixed hinge 124 of the rotary linkage 108 is the first end portion 118 and the rotary hinge 128 of the rotary linkage 108 is at the middle portion 122. As the latch 100 transitions from the closed position to the open position, the fixed hinge 124 translates within the guide slot 106 from the first portion 118 to the middle portion 122 and the rotary hinge 128 translates within the guide slot 106 from the middle portion 122 to the second end portion 120. The fixed hinge 124 is coupled to the pin which is securely coupled to the housing 134. The stationary securement of the pin 112 causes the rotary linkage 108 to rotate in rotational direction 150 about the fixed hinge 124. Rotation of the rotary linkage 108 displaces the support bracket 102 in sliding direction 160.

Figure 6:
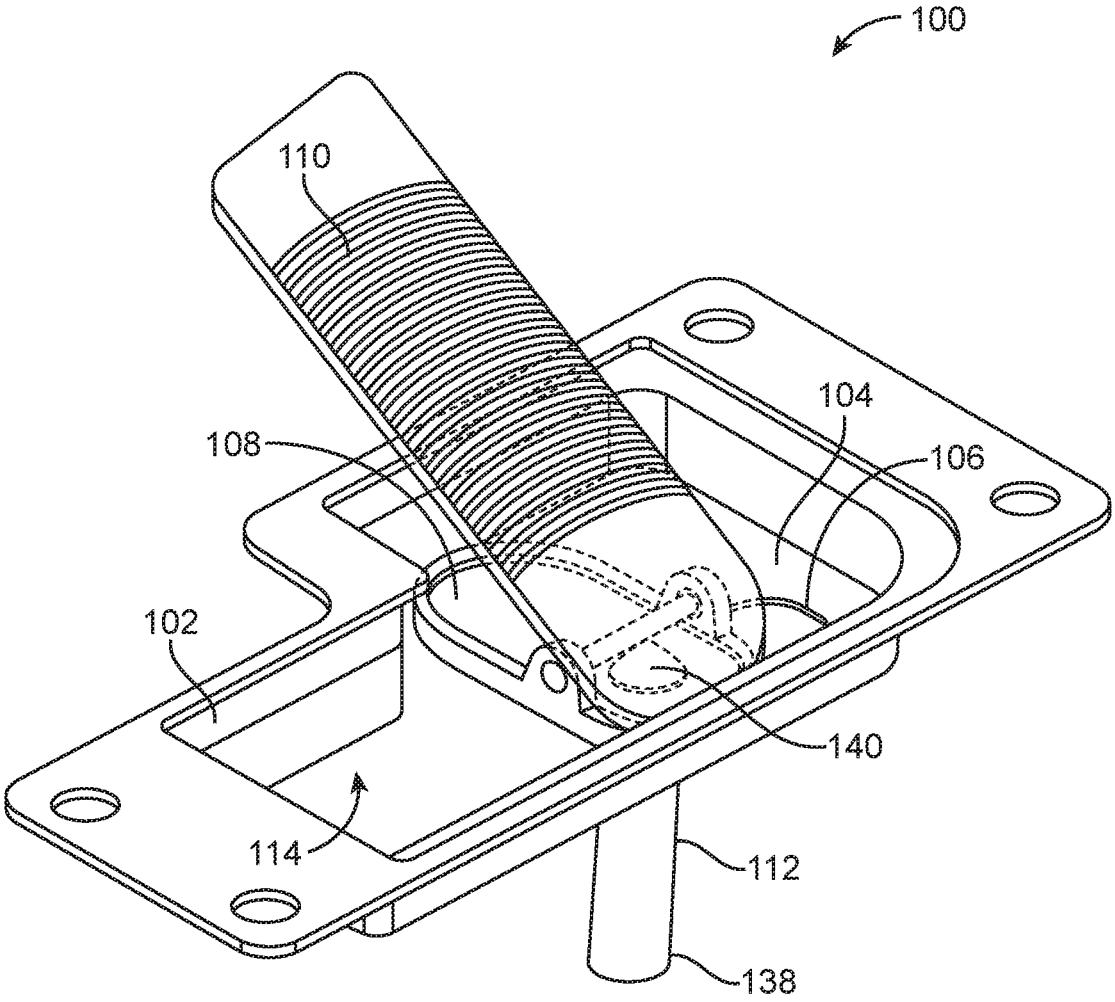
FIG. 6 is an elevational view of a releasable latch in an open position in accordance with an example embodiment of the present technology.
Figure 7:
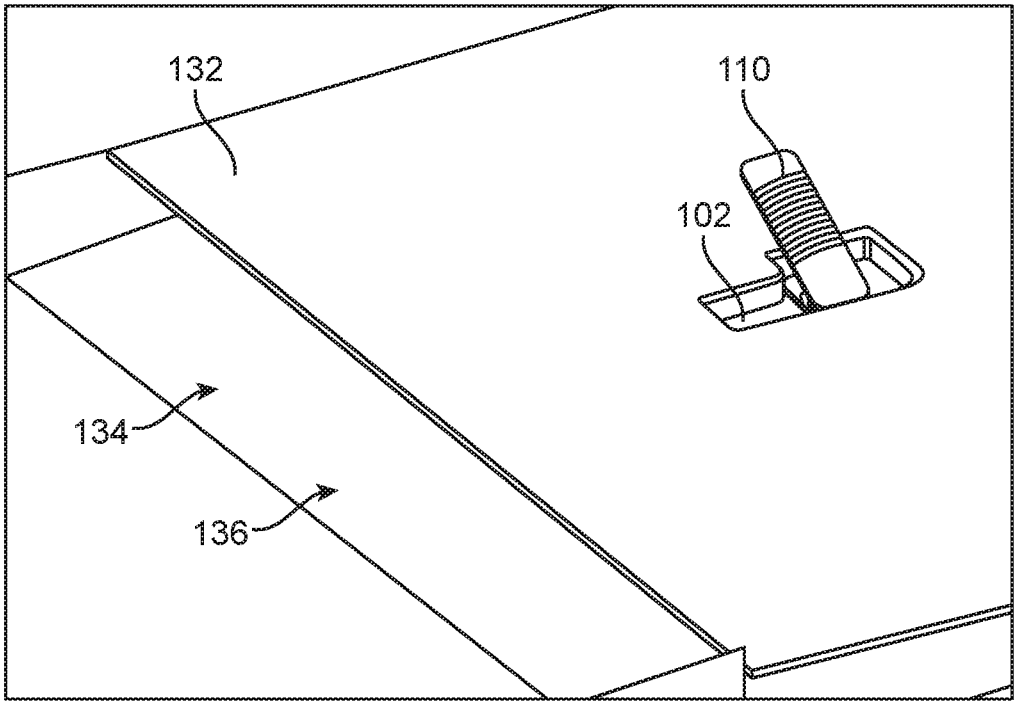
FIG. 7 is an isometric view of a releasable latch in an open position in accordance with an example embodiment of the present technology.

FIGS. 6 and 7 illustrate an example embodiment of a releasable latch in an open position. In the closed position, the rotary hinge 128 is at the second end portion 120 of the guide slot 106 and the fixed hinge 124 is at the middle portion 122 of the guide slot 106. The pin 112 can be decoupled from the rotary linkage 108.

As can be appreciated in FIGS. 6 and 7, the latch 100 is coupled to a cover 132 of a housing 134. The cover 132 is displaced with respect to closed position relative to the housing 134. The cover 132 is removable from the housing 134 when the latch 100 is in the open position and the pin 112 can be decoupled from the rotary linkage 108. In the open position, the handle 110 and rotary linkage 108 are substantially perpendicular to their original orientation because the rotary linkage 108 has translated within the L-shaped guide slot 106.

Figure 8:
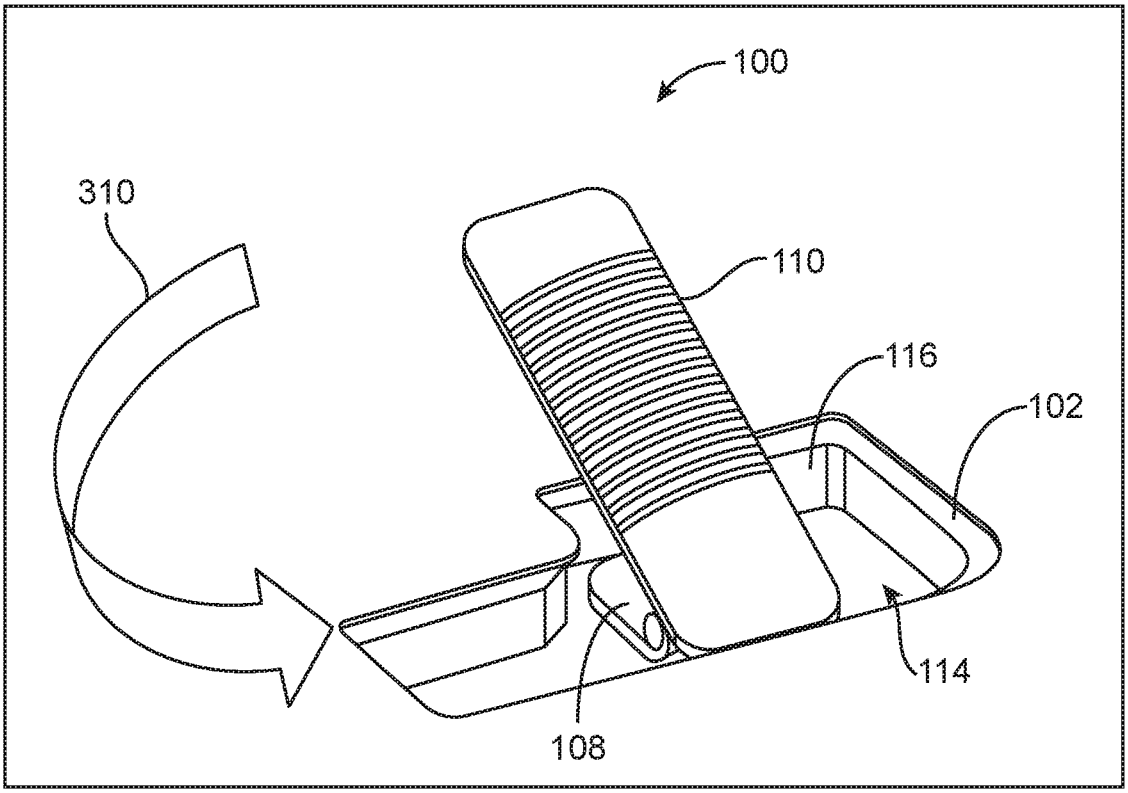
FIG. 8 is an elevational view of a releasable latch in an open position in accordance with an example embodiment of the present technology.

FIG. 8 illustrates an example embodiment of a releasable latch transitioning from an open position to a closed position. The latch 100 transitions from the open position to the closed position by actuating the handle in rotational direction 310. In at least one embodiment, the pin 112 is received in the rotary linkage 108 as the handle 110 is actuated in rotational direction 310. The rotary linkage 108 is coupled to the handle 110 and travels within guide slot 106 as the latch transitions from the closed position to the open position. As the rotary linkage 108 translates within the guide slot 106, the fixed hinge 124 moves from the middle portion 122 to the first end portion 118 and the rotary hinge 128 moves from the second end portion 120 to the middle portion 122. The cover 132 of the housing 134 slides in a direction substantially opposite the sliding direction 160, thereby engaging the at least one sidewall 128 of the housing 134 and securing the cover 132 to the housing 134.

In other embodiments, the latch 100 can be transitioned from the open position to the closed position without the pin 112 being received in the rotary linkage 108. The handle 110 is then received back in the receiving space 114.

Figure 9:
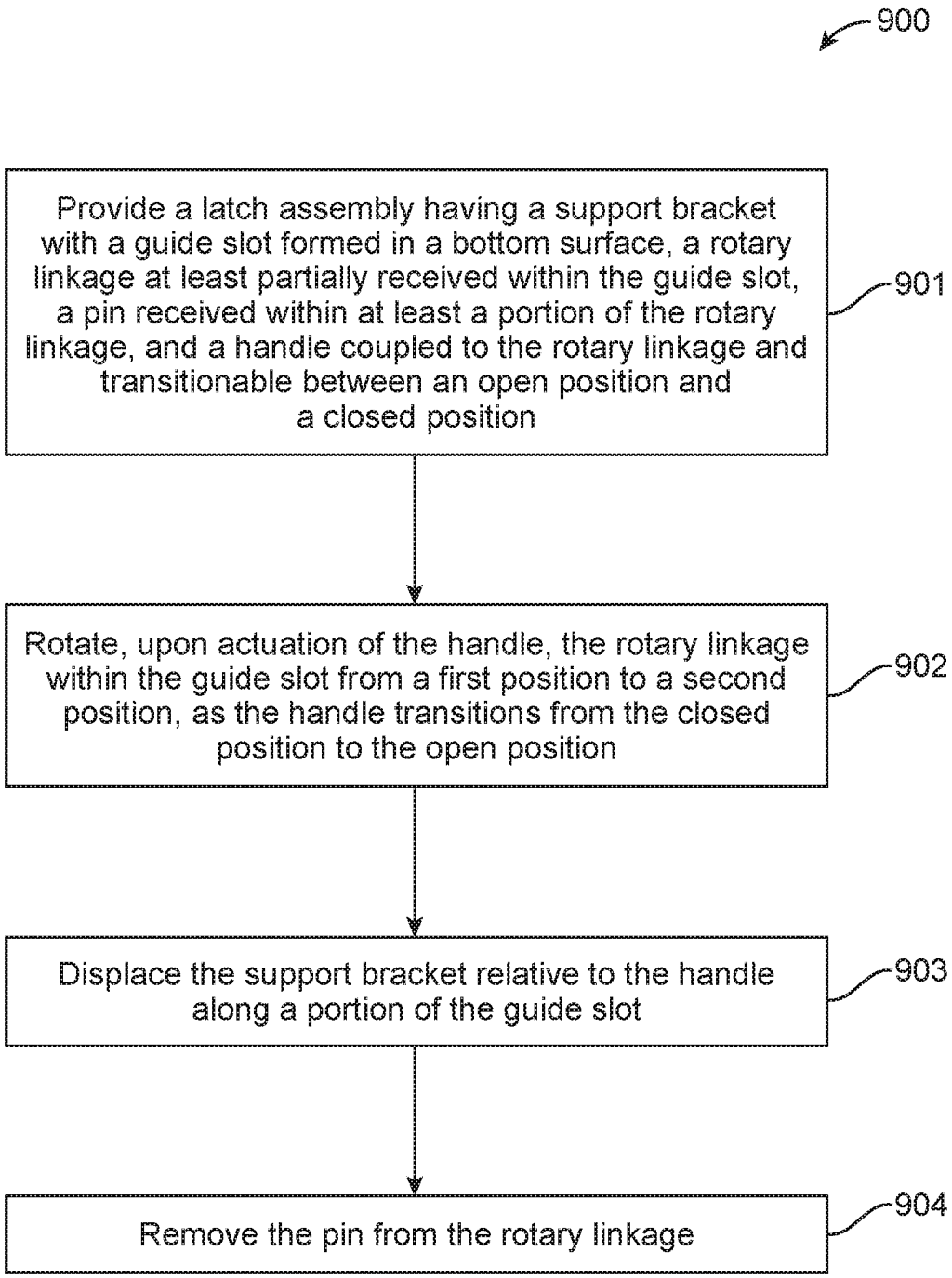
FIG. 9 is flowchart of an example method of a releasable latch.

Referring to FIG. 9, a flowchart is presented in accordance with an example embodiment. The example method 900 is provided by way of example, as there are a variety of ways to carry out the method 900. The method 900 described below can be carried out using the configurations illustrated in FIGS. 1-8, for example, and various elements of these figures are referenced in explaining example method 900. Each block shown in FIG. 9 represents one or more processes, methods or subroutines, carried out in the example method 900. Furthermore, the illustrated order of blocks is illustrative only and the order of the blocks can change according to the present disclosure. Additional blocks may be added or fewer blocks may be utilized, without departing from this disclosure. The example method 900 can begin at block 901.

At block 901 a latch assembly is provides a support bracket with a guide slot formed in a bottom surface, a rotary linkage at least partially received within the guide slot, a pin received within at least a portion of the rotary linkage, and a handle coupled to the rotary linkage and transitionable between an open position and a closed position.

At block 902, the rotary linkage is rotated, upon actuation of the handle, within the guide slot from a first position to a second position. The handle can actuate to transition from the closed position to the open position. In at least one embodiment, the guide slot is substantially L-shaped having two end portions and a middle portion.

At block 903 the support bracket displaces relative to the handle along at least a portion of the guide slot. In at least one embodiment, the rotary linkage has a fixed hinge at a first end, and a rotary hinge at a second end. As the rotary hinge transitions from the first position to the second position, the fixed hinge moves within the guide slot from one of the two end portions to the middle portion and the rotary hinge moves within the guide slot from the middle portion to the other of the two end portions At block 904, the pin is removable from the rotary linkage when the latch is in the open position.

Figure 10:
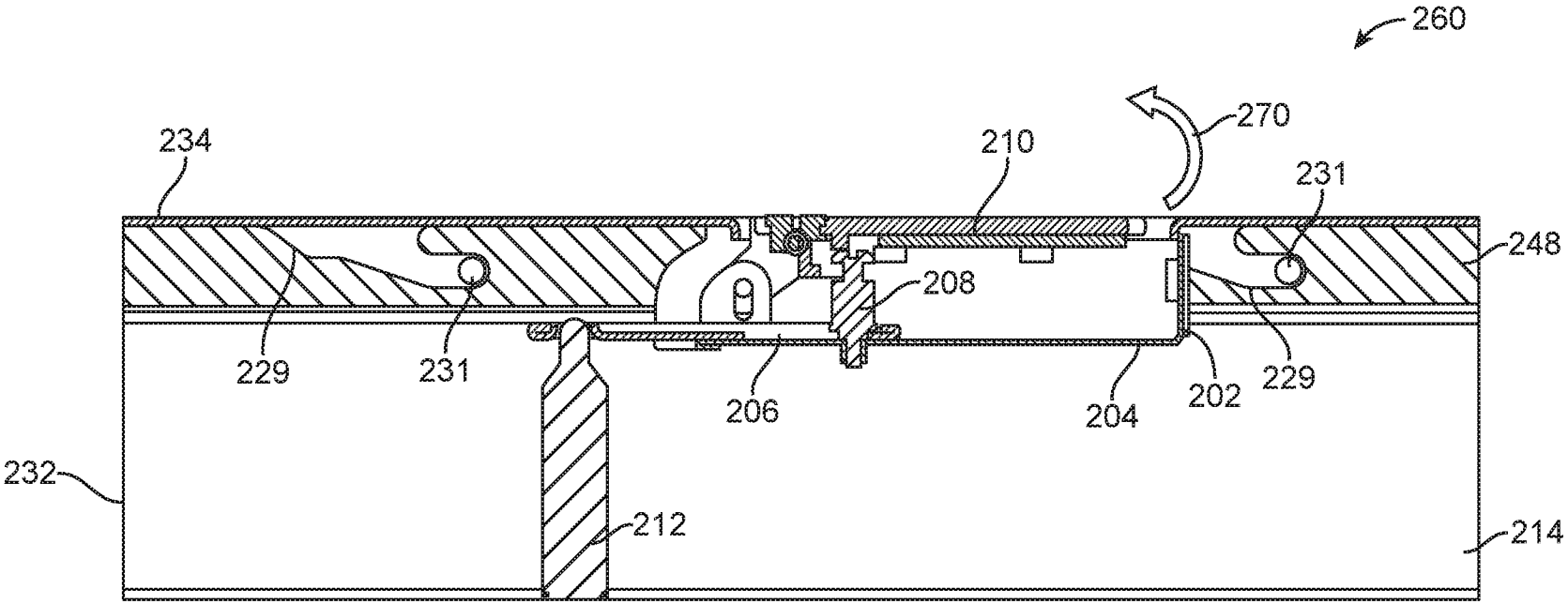
FIG. 10 illustrates a cross section view of an example second embodiment of a latch in a closed position.

FIG. 10 illustrates a cross section view of an example second embodiment of a latch 200 in a closed position. The latch 200 has a support bracket 202 having a bottom surface 204. The latch 200 also includes a handle 210 coupled with a linkage 208. The handle 210 can be pivotably coupled with the support bracket 202, thus allowing the handle 210 to be lifted and lowered relative to the support bracket 202. In at least one embodiment, the handle 210 and the bottom surface 204 of the support bracket 202 are substantially parallel in an unlifted position and not parallel when the handle 210 is lifted relative to the support bracket 202. A pin 212 is fixed relative to the latch 200 and receivable through the bottom surface 204 of the bracket 202 and releasably coupled with the latch 200.

The handle 210 is transitionable between an open position and a closed position. In the open position, the pin 212 is removable from the bottom surface 204 of the support bracket, such that as a server assembly cover 234 is removed from a server assembly 232 the pin 212 is removed from the bottom surface 204. As the handle 210 transitions between the open position and the closed position, the linkage 208 moves within the guide slot 206. In the closed position, the pin 212 is securely received in the bottom surface 204 and coupled with the support bracket 202. The handle 210 and pin 212 can be substantially linearly aligned, such an actuation direction 270 of the handle is substantially aligned with the pin 212. In other embodiments, the handle 210 and pin 212 can be offset such that actuation direction 270 is parallel with the pin 212 and direction of travel of the server assembly cover 234.

The server assembly cover 234 can be secured to the server assembly housing 232 by one or more protrusions 231 extended from a peripheral edge of the cover 234. The server assembly housing 232 can form a receiving space 214 configured to receive one or more components of an electronic device including, but not limited to, storage devices, motherboards, memory, processors, fans, and power supplies.

The one or more protrusions 231 are receivable within a corresponding groove 229 formed on a sidewall 248 of the server assembly 232. As the handle 210 transitions from the closed potion to the open position, the cover 234 slides relative to the server assembly housing 232 thus translating the one or more protrusions 231 within the corresponding groove 229. As can be appreciated in FIGS. 10-12, the corresponding groove has a slopped bottom surface configured to raise the cover 234 as the one or more protrusions 231 move from one end of the corresponding groove 233 to the other. Raising the cover 234 also raises the support bracket 202 relative to the pin 212. As the support bracket 202 is raised, a smaller portion of the non-fixed end of the pin 212 is received in the support bracket 202.

Figure 11:
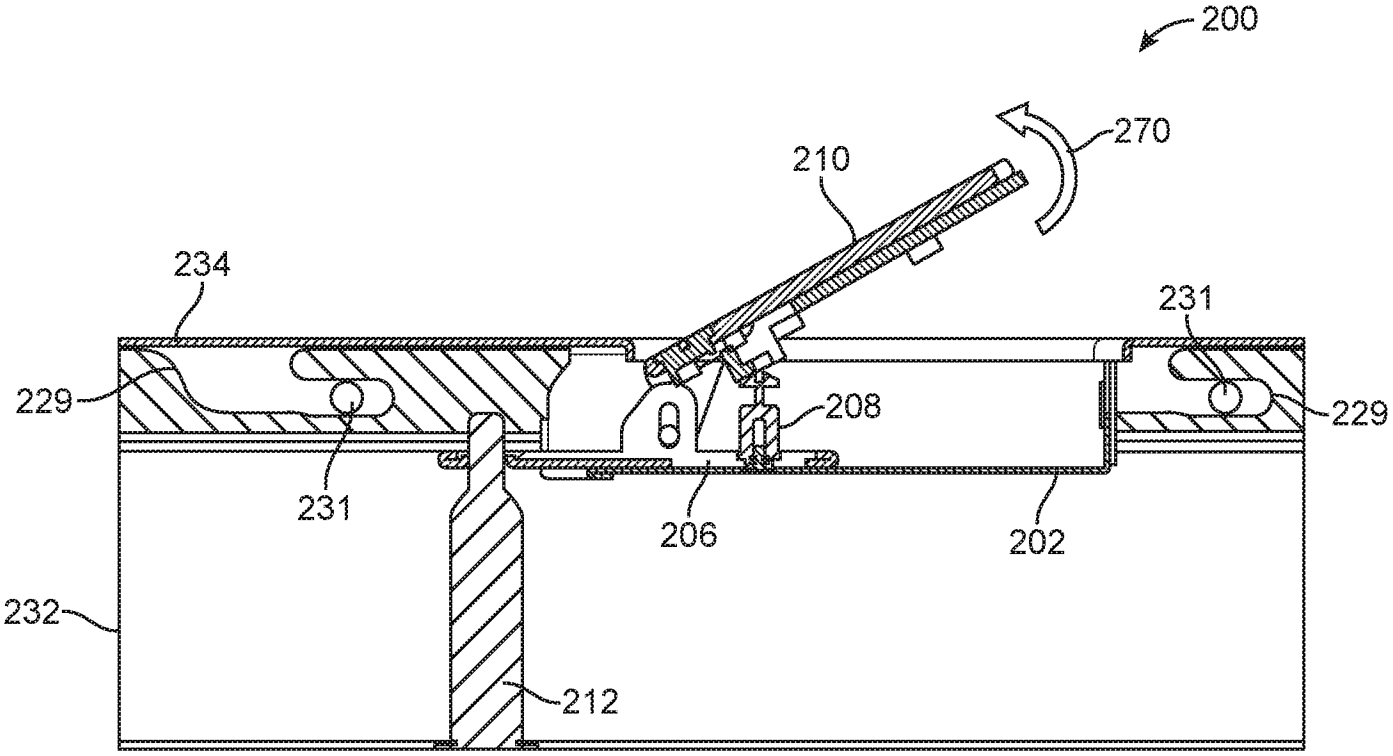
FIG. 11 illustrates a cross section view of an example second embodiment of a latch in a partially open position.

FIG. 11 illustrates a cross section view of an example second embodiment of a latch 200 in a partially open position. The handle 210 is pivoted in actuation direction 270 and raised above the cover 234. The pivoting of the handle 210 displaces the linkage 208 within the guide slot 206. The movement of the handle 210 and the interaction with the pin 212 fixed to the server assembly housing 232 can generate a corresponding movement of the cover 234 relative to the server assembly housing 232. The sliding of the cover 234 moves the one or more protrusions 231 within the corresponding groove 229. In at least one embodiment, the cover 234 and one or more protrusions 231 are displaced approximately 2 millimeters. In other embodiments, the cover 234 and the one or more protrusions 231 can be displaced any distance depending on the length of the guide slot 206 and the corresponding groove 229, for example between 1 millimeter and 15 millimeters.

Figure 12:
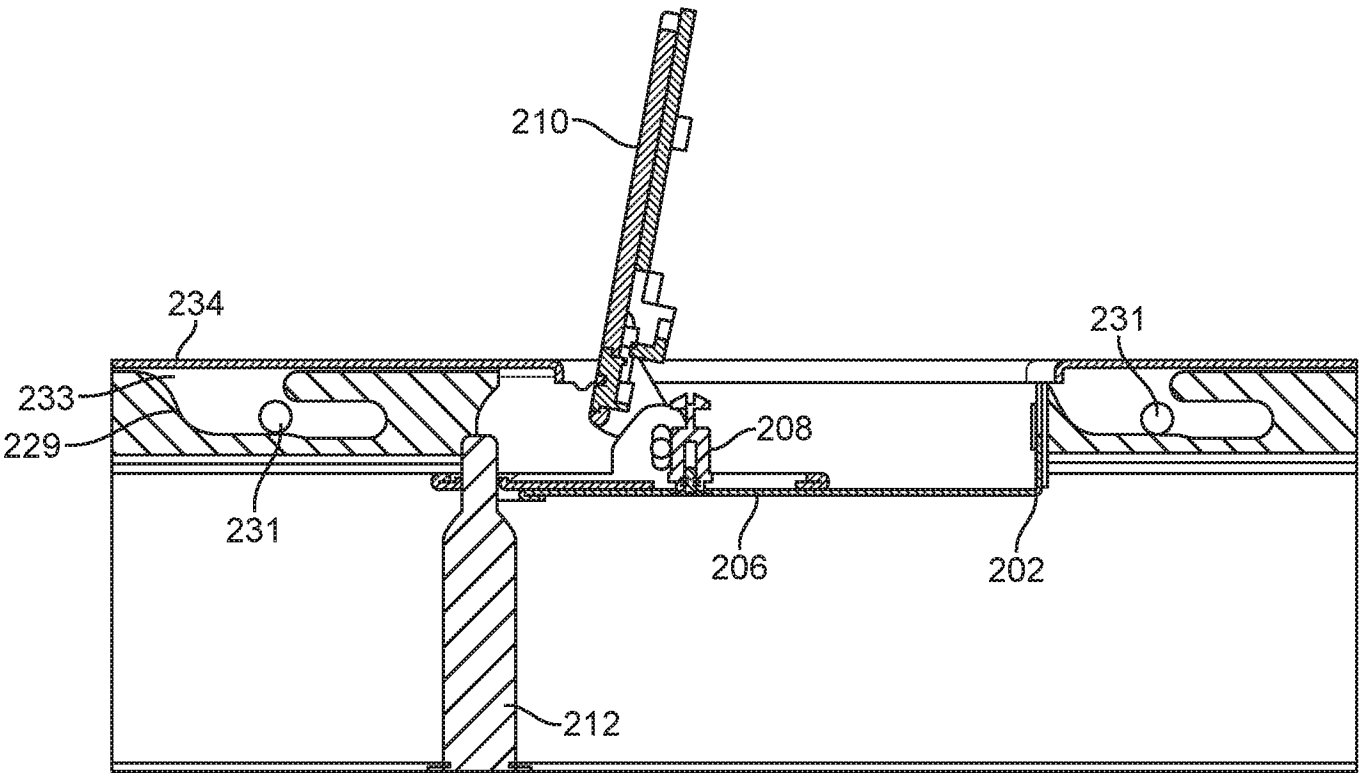
FIG. 12 illustrates a cross section view of an example second embodiment of a latch in an open position.

FIG. 12 illustrates a cross section view of an example second embodiment of a latch 200 in an open position. The handle 210 is pivoted in the actuation direction 270 to be substantially perpendicular to the bottom surface 204 of the support bracket 202. The pivoting displaces the linkage 208 further within the guide slot 206 with respect to FIG. 11, thus causing further displacement of the cover 234 and the one or more protrusions 231 relative to the server assembly housing 232. The displacement of the cover 234 is a result of the pin 212 received into the support bracket 202 of the latch 200 being fixed to the server assembly housing 232. In at least one embodiment, the cover 234 and one or more protrusions 231 are displaced approximately 10 millimeters. In other embodiments, the cover 234 and the one or more protrusions 231 can be displaced any distance depending on the length of the guide slot 206 and the corresponding groove 229, for example between 2 millimeter and 50 millimeters.

The displacement of the one or more protrusion 231 within the corresponding groove 229 aligns the one or more protrusion 231 with a groove entry point 233. When aligned, the cover 234 can be decoupled from the server assembly housing 232 as the one or more protrusions 231 are removed from the corresponding groove 229 through the groove entry point 233. As can be appreciated in FIG. 12, the groove entry point 233 is at the upper edge of the corresponding groove 229 allowing the cover 234 to be decoupled from the server assembly housing 232 in a vertical direction. In other embodiments, the groove entry point 233 can be positioned at any edge of the corresponding groove 229 to allow decoupling of the cover 234 from the server assembly housing 232.

It is believed the exemplary embodiment and its advantages will be understood from the foregoing description, and it will be apparent that various changes may be made thereto without departing from the spirit and scope of the disclosure or sacrificing all of its advantages, the examples hereinbefore described merely being preferred or exemplary embodiments of the disclosure.

What is claimed is:

1. A latch comprising:

a support bracket, the support bracket comprising sidewalls and bottom surface, the support bracket having a guide slot formed in the bottom surface;

a linkage at least partially received within the guide slot;

a handle coupled to the linkage and transitionable between an open position and a closed position; and a pin releasbly coupled to the linkage wherein:

when the handle is in the closed position, the pin is coupled to the linkage and when the handle is in the open position the pin is removable from the linkage; and as the handle transitions from the open position to the closed position the linkage moves within the guide slot, wherein the guide slot is L-shaped having two end portions and a middle portion, and wherein the linkage is a rotatory linkage and has a fixed hinge at a first end, and a rotary hinge at a second end and as the rotary hinge transitions from the closed position to the open position, the fixed hinge moves within the guide slot from one of the two end portions to the middle portion and the rotary hinge moves within the guide slot from the middle portion to the other of the two end portions.

2. A latch comprising:

a support bracket, the support bracket comprising sidewalls and bottom surface, the support bracket having a guide slot formed in the bottom surface;

a linkage at least partially received within the guide slot;

a handle coupled to the linkage and transitionable between an open position and a closed position; and a pin releasbly coupled to the linkage wherein:

when the handle is in the closed position, the pin is coupled to the linkage and when the handle is in the open position the pin is removable from the linkage; and as the handle transitions from the open position to the closed position the linkage moves within the guide slot, wherein the support bracket is integrally formed within a lid of a housing, and wherein the housing has a receiving space and the pin has two ends, a first end secured within the receiving space of the housing and a second end receivable in the linkage.

3. A method of operating a latch assembly for providing access to a housing, the method comprising:

actuating a handle of a latch assembly having a support bracket, the support bracket comprising sidewalls and a bottom surface, the bottom surface being provided with a guide slot formed therein, a linkage at least partially received within the guide slot, a pin receiveable within at least a portion of the linkage, and a handle coupled with the linkage such that the linkage transitions within the guide slot from a first position to a second position as the handle transitions from a closed position to an open position thereby transitioning the latch from a closed position to an open position; and displacing the handle relative to the support bracket along a portion of the guide slot.

4. The method of claim 3, further comprising removing the pin from the linkage when the latch is in the open position.

5. The method of claim 3, wherein the guide slot is L-shaped having two end portions and a middle portion.

6. The method of claim 5, wherein the linkage is a rotatory linkage and has a fixed hinge at a first end, and a rotary hinge at a second end and as the rotary hinge transitions from the first position to the second position, the fixed hinge moves within the guide slot from one of the two end portions to the middle portion and the rotary hinge moves within the guide slot from the middle portion to the other of the two end portions.

* * * * *